United States Patent [19]

Bellows

[11] Patent Number: 4,561,492

[45] Date of Patent: Dec. 31, 1985

[54] ELEMENT BASKET ASSEMBLY FOR HEAT EXCHANGER

[75] Inventor: Kenneth O. Bellows, Wellsville, N.Y.

[73] Assignee: The Air Preheater Company, Inc., Wellsville, N.Y.

[21] Appl. No.: 692,963

[22] Filed: Jan. 22, 1985

[51] Int. Cl.[4] ..... F28D 19/04

[52] U.S. Cl. ..... 165/8; 165/10

[58] Field of Search ..... 165/8, 10

[56] References Cited

U.S. PATENT DOCUMENTS

| | | | |
|---|---|---|---|
| 3,314,472 | 4/1967 | Krumm et al. | 165/10 |
| 4,345,640 | 8/1982 | Cullinan | 165/10 |

FOREIGN PATENT DOCUMENTS

| | | | |
|---|---|---|---|
| 150407 | 9/1981 | German Democratic Rep. | 165/8 |
| 503857 | 4/1939 | United Kingdom | 165/10 |
| 560106 | 6/1977 | U.S.S.R. | 165/10 |

*Primary Examiner*—Albert W. Davis, Jr.
*Attorney, Agent, or Firm*—William W. Habelt

[57] ABSTRACT

An element basket assembly (30) for a rotary regenerative heat exchanger (2) comprised of a plurality of heat transfer element plates (32) stacked in an array between first and second end plates (34,36) disposed at opposite ends of the stacked array of heat transfer element plates (32). First and second side straps (40,50) run along opposite sides of the stacked array of heat transfer element plates, to interconnect the first and second end plates (34,36) to form the element basket housing the heat transfer element plates. The first side strap (40) is disposed to extend diagonally from a higher location on the first end plate (34) to a location on the second end plate (36), while the second side strap (50) is disposed on the opposite side of the stacked array to extend diagonally from a lower location on the first end plate (34) to a higher location on the second end plate (36), that is diagonally opposite to the first side strap (40).

2 Claims, 4 Drawing Figures

ELEMENT BASKET ASSEMBLY FOR HEAT EXCHANGER

BACKGROUND OF THE INVENTION

The present invention relates to heat transfer element baskets and, more specifically, to an assembly of heat absorbent plates in a basket for use in a heat exchanger wherein heat is transferred by means of the plates from a hot heat exchange fluid to a cold heat exchange fluid. The present invention has particular application in heat transfer apparatus of the rotary regenerative type wherein the heat transfer element is heated by contact with a hot gaseous heat exchange fluid and thereafter brought in contact with a cool gaseous heat exchange fluid to which the heat transfer element gives up its heat.

One type of heat exchange apparatus commonly used for gas-to-gas heat exchange in the process industry and for gas-to-air heat exchange on utility steam generators is the well-known rotary regenerative heat exchanger. Typically, a rotary. regenerative heat exchanger has a cylindrical rotor divided into compartments in which are disposed a mass of heat transfer element which, as the rotor turns, is alternately exposed to a stream of heating gas and then upon rotation of the rotor to a stream of cooler air or other gaseous fluid to be heated. The heat absorbent mass typically comprises a plurality of heat transfer element basket assemblies mounted in sector shaped compartments. Each of the heat transfer element basket assemblies houses a plurality o heat transfer plates which when exposed to the heating gas absorb heat therefrom and then when exposed to the cool air or other gaseous fluid to be heated, the heat absorbed from the heating gas by the heat transfer plates is transferred to the cooler gas.

Typically, such an element basket assembly comprises a pair of spaced end plates held together by paired side straps interconnecting the end plates along the sides thereof. A plurality of heat transfer plates are stacked in closely spaced relationship within the basket housing to provide a plurality of passageways between adjacent plates through which the heat exchange fluids pass. One or more retaining bars are welded between the end plates across the top and bottom ends thereof to prevent the heat transfer element plates from falling out of the open ends of the element basket. The side straps which interconnect the spaced end plates extend in pairs along the opposite sides of the stacked array of heat exchange elements. On each side of the heat exchange element is a first side strap extending between the upper regions of the spaced end plates and a second side strap extending between the lower region of the end plates in spaced, parallel relationship to the first side strap.

Although such basket assemblies are commonly used, a problem sometimes arises when two basket assemblies of this type are disposed side-by-side and is a sector compartment of a heat exchanger. It is not unusual for the side straps to bow after a period of time in the heat exchanger due to the influence of the hot gases flowing through the element baskets. When the side straps have bowed, it is often difficult to remove the element baskets from the sector compartments of the heat exchanger as the bowed side straps will hang up on side straps of adjacent baskets as the element basket is pulled out of the heat exchanger. As the heat exchange element deteriorates during normal operation, it is necessary to periodically replace all of the elements within the heat exchanger.

It is, therefore, an object of the present invention to provide an improved element basket assembly designed to preclude the hangup of element baskets during removal due to the bowing of the side straps.

SUMMARY OF THE INVENTION

To the fulfillment of this object and other objects which will be evident from the description presented herein, the element basket assembly of the present invention comprises a plurality of heat transfer element plates disposed in a stacked array between first and second end plates disposed at opposite ends of the stacked array of the heat transfer element plates in abutting relationship therewith. At least one first side strap interconnects the first and second end plates and runs diagonally along one side of the stacked array of heat transfer element plates from a lower location on the first end plate to a higher location on the second end plate. Additionally, at least one second side strap interconnects the first and second end plates and runs diagonally along the opposite side of the stacked array of heat transfer element plates from a higher location on the first end plate to a lower location on the second end plate.

In this manner, the first and second side straps disposed along opposite sides of the stacked array of heat transfer element run diagonally opposite each other. Thus, if either or both of the side straps is subject to bowing during normal operation, the side straps will shear against each other when the element basket is installed into or removed from the sector compartment of the heat exchanger but will be unable to hang up. Thus, at least one side strap is provided on each side of the element basket which according to the present invention runs diagonally along the sides of the element basket with the side straps on opposite sides of the element basket running diagonally across each other so as to preclude the possibility of hanging up due to bowing during the removal of the element baskets from the heat exchanger.

DESCRIPTION OF A PREFERRED EMBODIMENT

Figure 1:
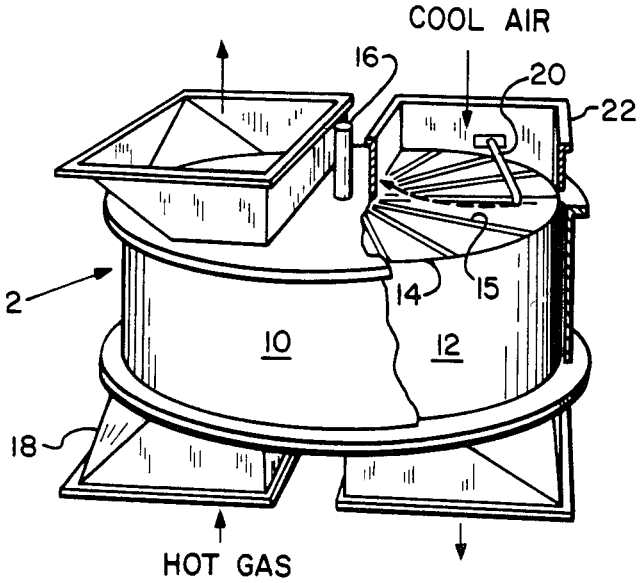
FIG. 1 is a prespective view of a rotary regenerative heat exchanger.

Referring now to the drawings and mOre partiCularly to FIG. 1, there is depicted therein a regenerative heat exchanger apparatus 2 in which the heat transfer element basket assemblies of the present invention may be utilized. The rotary regenerative heat exchanger 2 comprises a housing 10 enclosing a rotor 12 wherein the heat transfer element basket assemblies of the present invention are carried. The rotor 12 comprises a cylindrical shell 14 connected by radially extending diaphragms 15 to the rotor post 16. A heating fluid enters the housing 10 through duct 18 while the fluid to be heated enters the housing 10 from the opposite end thereof through duct 22.

The rotor 12 is turned about its axis by a motor connected to the rotor post 16 through suitable reduction gearing, not illustrated here. As the rotor 12 rotates, the heat transfer element plates carried within the element basket assemblies disposed within the rotor are first moved in contact with the heating fluid entering the housing through the duct 18 to absorb heat therefrom and then into contact with the fluid to be heated entering the housing through duct 22. As the heating fluid passes over the heat transfer element plates, the heat transfer element plates absorb heat therefrom. As the fluid to be heated subsequently passes over the heat transfer element plates, the fluid absorbs from the heat transfer element plates the heat which the plates had picked up when in contact with the heating fluid.

Rotary regenerative heat exchangers are often utilized as air preheaters wherein the heat absorbent element serves to transfer heat from the hot flue gases generated in a fossil fuel-fired furnace to ambient air being supplied to the furnace as combustion air as a means of preheating the combustion air and raising overall combustion efficiency. Very often, the flue gas leaving the the furnace is laden with particulate generated during the combustion process. This particulate has a tendency to deposit on heat transfer element plates particularly at the cold end of the heat exchanger where condensation of any moisture in the flue gas may occur. In order to provide for periodic cleaning of the heat transfer element disposed within the element basket assemblies, the heat exchanger is provided with a cleaning nozzle 20 disposed in the passage for the fluid to be heated adjacent the cold end of the rotor 12 and opposite the open end of the heat transfer element basket assemblies. The cleaning nozzle 20 directs a high pressure cleaning fluid, typically steam, water, or air, through the plates as they rotate slowly while the nozzle itself sweeps across the end face of the rotor. As the high pressure fluid passes over the heat transfer element plates, turbulence in the fluid stream causes the heat transfer element plates to vibrate so as to jar loose flyash and other particulate deposits clinging thereto. The loosen particulate is then entrained in the high pressure stream and carried out of the rotor.

The heat exchange material carried in the rotor 12 comprises a mass of metallic heat transfer element plates formed with corrugations or undulations such that when the plates are placed in abutting relationship in a stack array, a series of internal passages are provided through which the heating fluid and cooling fluid flow. The plates are typically assembled in an essentially trapezoidal-shaped frame, termed an element basket, that houses the stacked array of plates with the individual plates held in their stacked order so that they may be handled as an integral assembly for placement within the sector-shaped compartments within the rotor of the heat exchanger.

Figure 4:
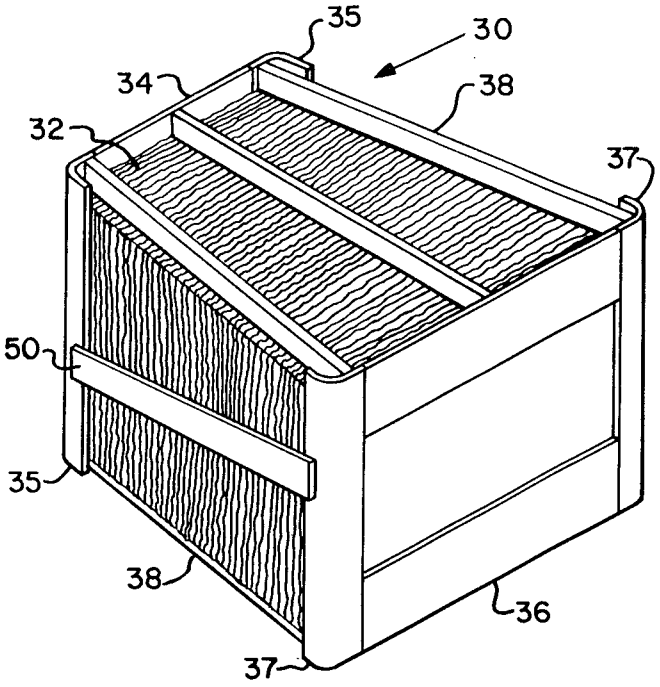
FIG. 4 is a perspective view of an element basket assembly designed in accordance with the present invention viewing the element basket assembly from the left side thereof.
Figure 3:
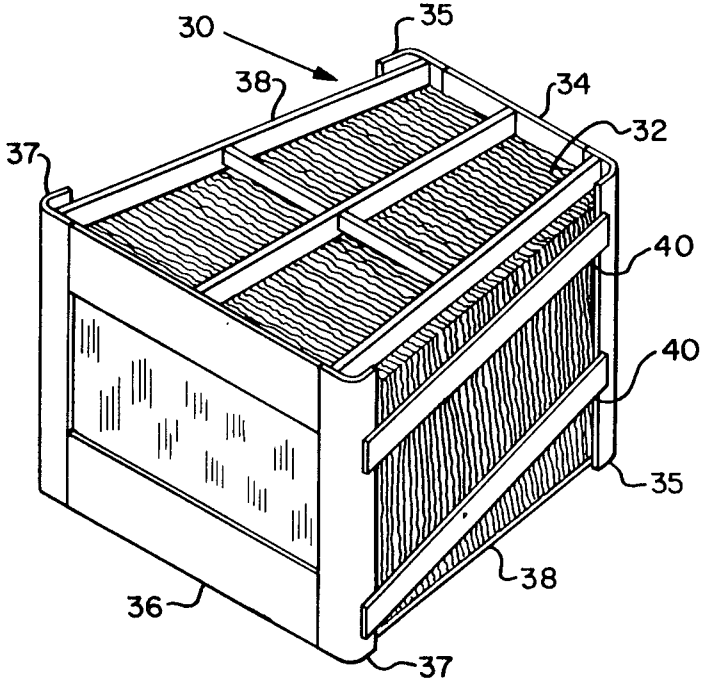
FIG. 3 is a perspective view of an element basket assembly designed in accordance with the present invention viewing the element basket assembly from the right side thereof.

As illustrated in FIGS. 3 and 4, the element basket assembly 30 of the present invention comprises a plurality of heat transfer element plates 32 juxtaposed in spaced relationship to provide a stacked array of plates having a plurality of flow passages therebetween so as to provide a flow path through which heat exchange fluid may pass in heat exchange relationship with the plates 32. The plates 32 are usually of thin sheet metal capable of being rolled or stamped to a desired configuration, however, the invention is not limited necessarily to the use of metallic plates. The plates 32 may be of various surface configuration such as, but not limited to, a flat surface or a corrugated or undulated surface, or a combination thereof with the flat plates stacked alternately between corrugated or undulated plates. In any case, the stacked array of element plates is disposed between a first end plate 34 at one end thereof and a second end plate 36 at the other end thereof. The end plates 34 and 36 abut the ends of the stacked array of heat transfer element plates and are held in position by means of side straps 40 and 50 which are disposed along opposite sides of the stacked array of heat transfer element plates to interconnect the spaced-apart first and second end plates 34 and 36. Additionally, retaining bars 38 are tack-welded between the end plates 34 and 36 at the open top and bottom of the element basket assembly 30 in order to prevent the heat transfer element plates 32 stacked therein from falling out the open ends of the basket element assembly 30.

Figure 2:
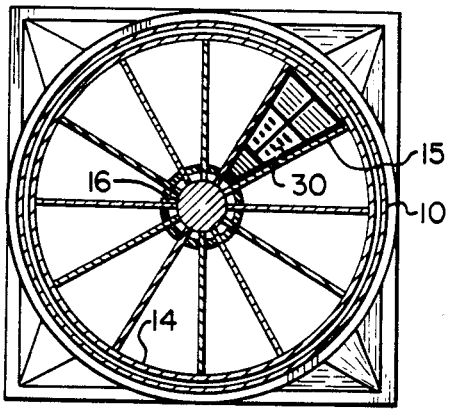
FIG. 2 is a plan view of the rotary regenerative heat exchanger of FIG. 1 taken along line 2—2.

In accordance with the present invention, at least one first side strap 40, shown in FIG. 3, interconnects the first and second end plates 34 and 36 and is disposed along one side, in this case the right side, of the stacked array of heat transfer element plates 32, so as to run diagonally from a higher location on the first end plate 34 to a lower location on the second end plate 36, while at least one second side strap 50, as seen in FIG. 4, interconnects the first and second plates 34 and 36 and is disposed along the other side, in this case the left side, of the stacked array of heat transfer element plates 32, so as to run diagonally from a lower location on the first end plate 34 to a higher location on the second end plate 36. Therefore, the side straps 40 and 50 disposed on opposite sides of the stacked array of heat transfer element plates 32 run diagonally opposite each other. Thus, when two element basket assemblies 30 are placed in a sector compartment in side-by-side relationship as seen in FIG. 2, the side straps of adjacent baskets will always run diagonal to each other and may be made to cross each other, if desired, by selecting a sufficiently steep diagonal along which to run the side straps. Therefore, when it is necessary to remove an element basket assembly 30 from the rotor 12, the side straps of the basket being moved will slide along the side straps of its adjacent baskets rather than hang up on the side straps of adjacent baskets as was experienced with the parallel horizontally disposed side straps utilized on prior art element basket assemblies.

To manufacture the element assembly 30, the inner end plate 34 of the element basket assembly 30 and the side straps 40 and 50 are welded together so as to extend from the end plate 34 along the opposite side of the element basket assembly and the retaining bars 38 are tack-welded to the inner end plate 34 at the top and bottom of the element basket 30. The heat transfer element plates 32 are then stacked in the element basket as they come off the cutting table until the element basket assembly 30 is completely full with a stacked array of heat transfer element plates 32 extending between the retaining bars 38 and the side straps 40, 50. The outer end plate 36 is then tack-welded to the retaining bars 38 and the free ends of the side straps 40 and 50 to enclose the heat transfer plates 32. The completed element basket 30 is then ready for shipment.

As shown in the drawing, the end plates 34 and 36 are preferably formed with flanges 35 and 37, respectively, extending outwardly from the lateral sides of the end plates along the sides of the stacked array of heat transfer element plates 32 for a distance sufficient to provide a surface to which the side straps 40 and 50 may be welded when interconnecting the end plates 34 and 36.

While the heat transfer element basket assembly has been shown embodied in a rotary regenerative heat exchanger of the type wherein the mass of heat absorbent material is rotated alternately between the heating fluid and the fluid to be heated, it would be appreciated by those skilled in the art that the heat transfer element assembly of the present invention can be utilized in a number of other known heat exchange apparatus of either regenerative or recuperative type. Additionally, various plate configurations, some of which have been alluded to herein, may be readily incorporated in the heat transfer basket assembly of the present invention by those skilled in the art. Therefore, it is intended by the appended claims to cover the modifications alluded to herein as well as all other modifications which fall within the true spirit and scope of the present invention as defined by said claims.

I claim:

1. An element basket assembly for a heat exchanger comprising:

a. a plurality of heat transfer element plates juxtaposed in a stacked array;

b. first and second end plates disposed at opposite ends of said stacked array of heat transfer element plates in abutting relationship therewith;

c. at least one first side strap interconnecting said first and second end plates, said at least one first side strap disposed along one side of said stacked array of heat transfer element plates so as to run diagonally from a higher location on said first end plate to a lower location on said second end plate; and d. at least one second side strap interconnecting said first and second end plates, said at least one second side strap disposed along the other side of said stacked array of heat transfer element plates opposite the side along which said at least one first side strap is disposed, said at least one second side strap running diagonally from a lower location on said first end plate to a higher location on said second end plate.

2. An element basket assembly for a heat exchanger as recited in claim 1 wherein each of said first and second end plates have a pair of side flanges extending outwardly along the sides of said stacked array of heat transfer elements and said first and second side straps are interconnected between the side flanges of said first and second end plates.

* * * * *